US008720800B2

(12) United States Patent
Wu

(10) Patent No.: US 8,720,800 B2
(45) Date of Patent: May 13, 2014

(54) SHOWER HEAD

(76) Inventor: Wei-Sheng Wu, New Taipei (TW)

( * ) Notice: Subject to any disclaimer, the term of this patent is extended or adjusted under 35 U.S.C. 154(b) by 294 days.

(21) Appl. No.: 13/299,256

(22) Filed: Nov. 17, 2011

(65) Prior Publication Data

US 2013/0126646 A1 May 23, 2013

(51) Int. Cl.

| | |
|---|---|
| ***A62C 31/00*** | (2006.01) |
| ***B05B 1/16*** | (2006.01) |
| ***B05B 1/18*** | (2006.01) |
| ***B05B 15/06*** | (2006.01) |

(52) U.S. Cl.

CPC ..... *B05B 1/1636* (2013.01); *B05B 1/18* (2013.01); *B05B 15/065* (2013.01); *B05B 15/066* (2013.01); *Y10S 239/04* (2013.01)

USPC ..... 239/449; 239/446; 239/447; 239/530; 239/588; 239/DIG. 4

(58) Field of Classification Search

CPC ..... B05B 1/18; B05B 1/1636; B05B 1/185; B05B 1/14; B05B 15/065; B05B 15/066

USPC ..... 239/443, 444, 446–449, 548, 552, 525, 239/530, 588, DIG. 4

See application file for complete search history.

(56) References Cited

U.S. PATENT DOCUMENTS

| | | | | |
|---|---|---|---|---|
| 5,551,637 | A * | 9/1996 | Lo | 239/449 |
| 5,697,557 | A * | 12/1997 | Blessing et al. | 239/447 |
| 5,918,816 | A * | 7/1999 | Huber | 239/525 |
| 7,918,408 | B2 * | 4/2011 | Tshieh | 239/530 |

* cited by examiner

*Primary Examiner* — Steven J Ganey

(57) ABSTRACT

A shower head includes a main body seal seat fixed to a main body. The main body seal seat is fitted in a rotation seat in a rotation way and located above a cover seal seat. The cover seal seat is fixed to a cover unit. The joint of the main body seal seat and the rotation seat has a groove to receive a first seal ring. The main body seal seat has at least one water inlet. The water inlet is provided with a spring and a second seal ring therein. The spring is located between the second seal ring and the water inlet of the main body seal seat. The cover seal seat has at least one through hole corresponding in position to the water inlet. The cover unit has at least one water outlet.

4 Claims, 10 Drawing Sheets

SHOWER HEAD

BACKGROUND OF THE INVENTION

1. Field of the Invention

The present invention relates to a bathing apparatus, and more particularly to a shower head.

2. Description of the Prior Art

Nowadays, a shower head is an essential apparatus for taking a bath. An improved shower head is developed to have different spray modes. The more functions of the shower head, the more complication of its configuration.

The shower head can be switched for different spray modes, so it needs a better seal configuration. However, the seal configuration of the conventional shower head uses a screw to fix a main body seal seat and a cover seal seat to a main body. There is a gap between the cover seal seat and the main body seal seat. A Y-shaped ring or a seal ring is provided to seal the gap.

As shown in FIG. 1 and FIG. 2, the main body seal seat 11 has an end seal through a seal ring 12 to seal the gap between the cover seal seat 13 and the main body seal seat 11. The seal ring 12 is compressed when assembled, which cannot be assembled with ease. Sometimes, the seal effect is not good to cause water leakage. As shown in FIG. 3 and FIG. 4, the main body seal seat 21 has a side seal through a Y-shaped ring 22 to seal the gap between the cover seal seat 23 and the main body seal seat 21. When assembled, this configuration may be lopsided or reversed or deformed to cause water leakage. In a word, these two structures have the following shortcomings: difficult assembly, lower production efficiency, high defective rate, high cost and the like.

The conventional spray head adopts a single water passage to spray water. The water hole and water passage are mated one by one. The water passes each water hole of this structure only once. It needs many water passages for different spray modes. This structure is complicated and cannot be produced in a large scale. Accordingly, the inventor of the present invention has devoted himself based on his many years of practical experiences to solve these problems.

SUMMARY OF THE INVENTION

The primary object of the present invention is to provide a shower head which has a better seal effect and lowers the cost.

In order to achieve the aforesaid object, the shower head of the present invention comprises a main body, a rotation seat, a main body seal seat, a cover seal seat, a cover unit and seal members installed between relative parts for water seal. The main body seal seat is connected to the main body. The main body seal seat is fitted in the rotation seat in a rotation way and located above the cover seal seat. The cover seal seat is fixed to the cover unit;

The joint of the main body seal seat and the rotation seat has a groove to receive a first seal ring. The main body seal seat has at least one water inlet. The water inlet is provided with a spring and a second seal ring therein. The spring is located between the second seal ring and the water inlet of the main body seal seat. The second seal ring is against the cover seal seat.

The cover seal seat has at least one through hole. The cover unit has at least one water outlet. The through hole communicates with the water outlet.

Preferably, the rotation seat has a first protruding step extending inward and the main body seal seat has a second protruding step extending outward. The first protruding step of the rotation seat is mated with the second protruding step of the main body seal seat. The first protruding step is formed with the groove to receive the first seal ring.

Preferably, the second seal ring has a flange extending upward from an outer edge thereof.

Preferably, the cover unit has three water outlets which are an outer water outlet, an inner water outlet and a central water outlet. Three water passages and a shift water passage are formed between the cover seal seat and the cover unit. The cover seal seat has five through holes which are disposed in the same circle. The main body seal seat has a blind hole which is located corresponding to the five through holes of the cover seal seat. An interval is defined between the water inlet and the blind hole. The blind hole comprises a seal pad therein. The water inlet communicates with one of the five through holes of the cover seal seat by means of rotation to open the relative water passage. The blind hole is to block the other through holes and close the other water passages.

Preferably, the cover seal seat has engaging buckles thereon, and the rotation seat has engaging notches and limit slots extending from the respective engaging notches.

The spring applies a force to the main body seal seat and the second seal ring. Because the second seal ring is against the cover seal seat, the cover seal seat and the main body seal seat have two opposing forces. One force is to compress the first seal ring between the main body seal seat and the rotation seat. The other force pushes the second seal ring to be against the cover seal seat tightly. The present invention has a better and stable seal effect.

To assemble the present invention, the first seal ring is placed in the groove of the rotation seat. The main body seal seat is fitted in the rotation seat to form a seal configuration. After that, the spring and the second seal ring are placed in the water inlet of the main body seal seat. Two ends of the spring are against the second seal ring and the water inlet, respectively. Finally, the engaging buckles of the cover seal seat are inserted in the engaging notches of the rotation seat and then engaged in the limit slots by clockwise turning the cover seal seat, so that the cover seal seat is secured under the main body seal seat. The present invention can be assembled with ease to lower the defective rate of production.

DETAILED DESCRIPTION OF THE PREFERRED EMBODIMENTS

Embodiments of the present invention will now be described, by way of example only, with reference to the accompanying drawings.

Figure 1:
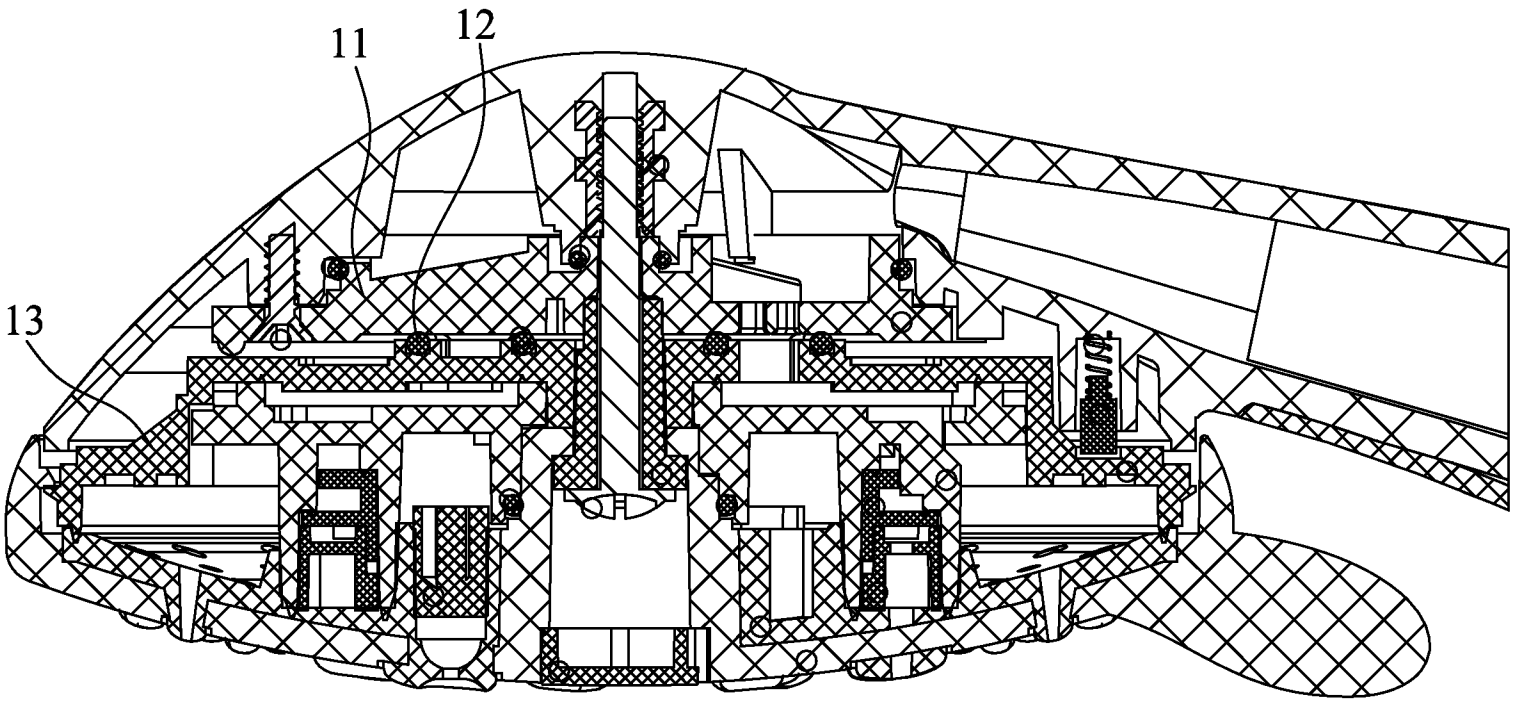
FIG. 1 Prior Art
FIG. 1 is a sectional view of a first conventional shower head.
Figure 2:
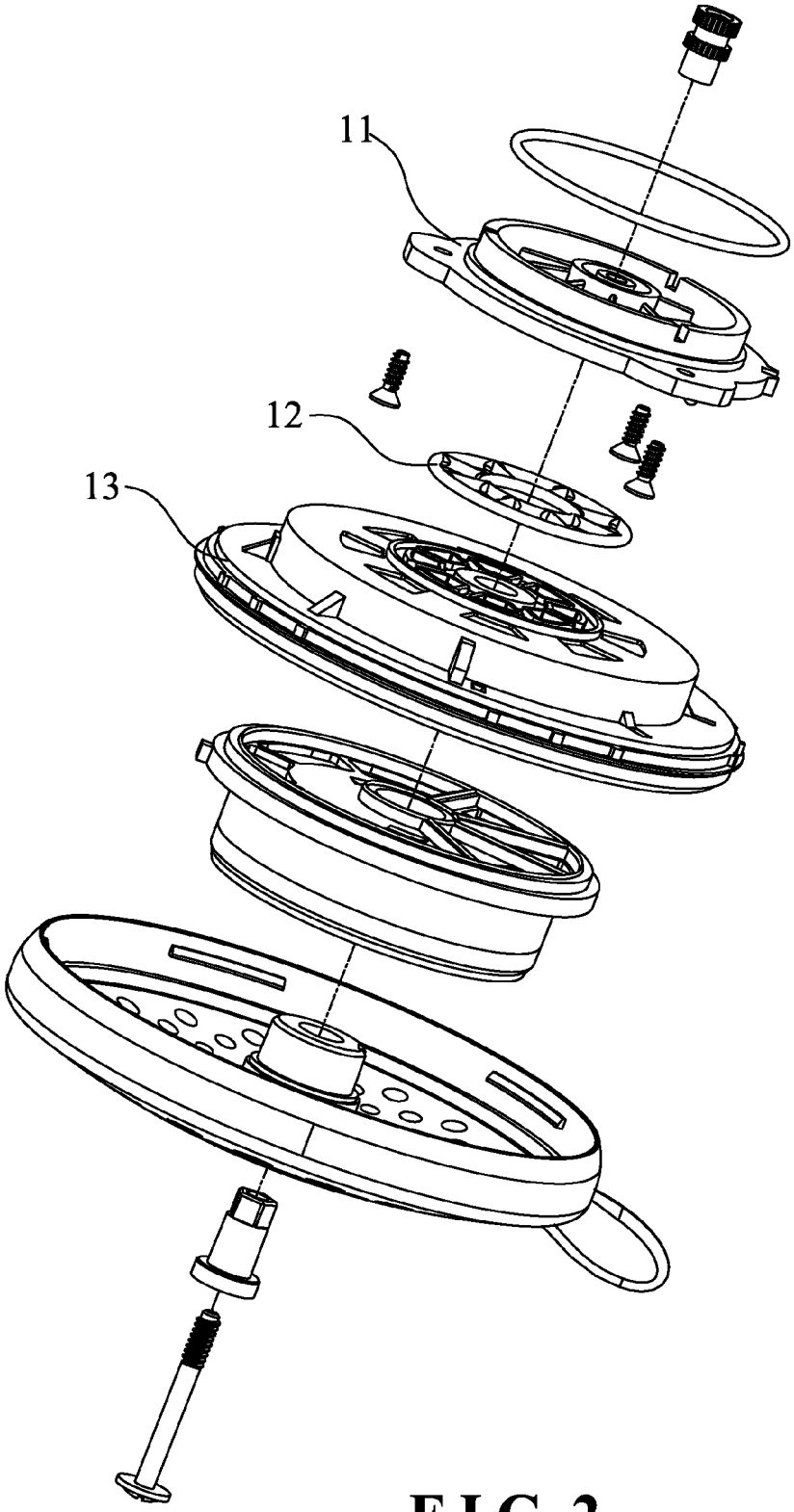
FIG. 2 Prior Art
FIG. 2 is an exploded view of the first conventional shower head.
Figure 3:
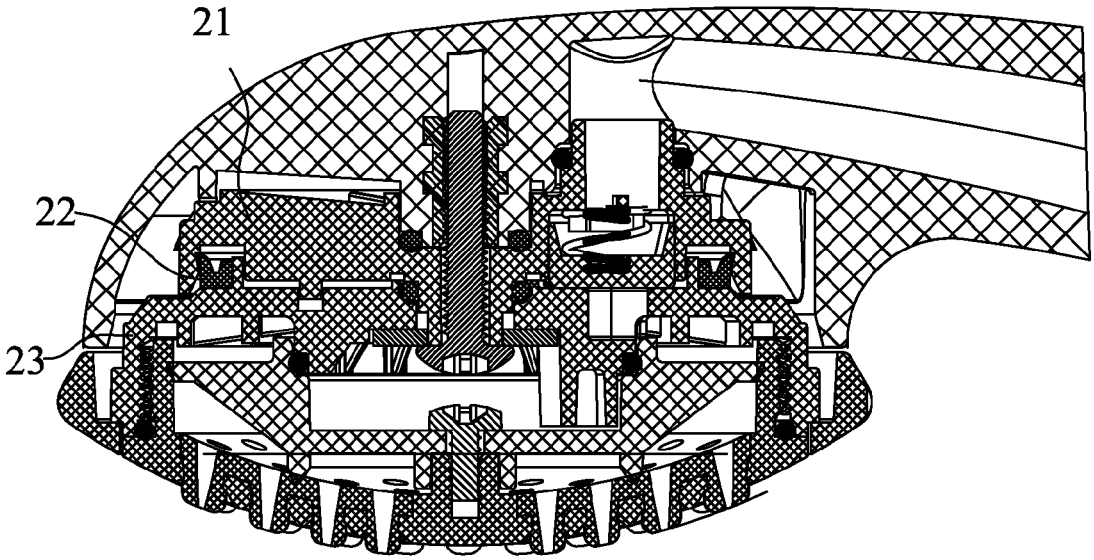
F I G. 3 Prior Art
FIG. 3 is a sectional view of a second conventional shower head.
Figure 4:
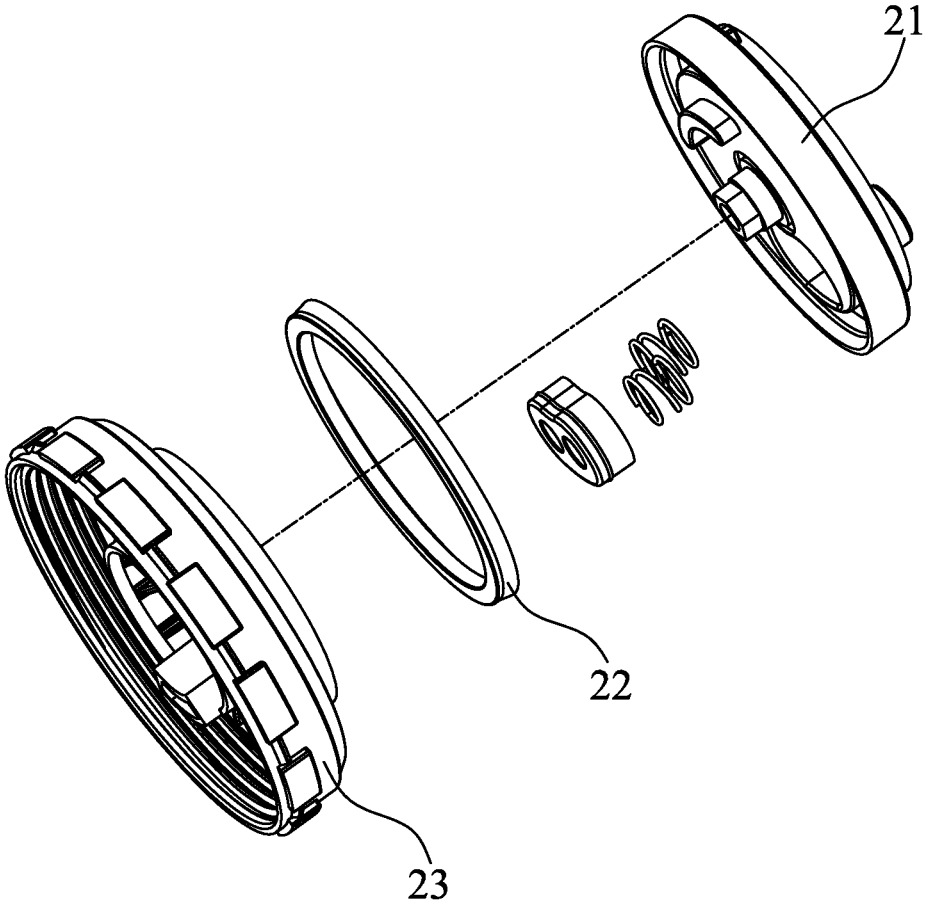
F I G. 4 Prior Art
FIG. 4 is an exploded view of the second conventional shower head.
Figure 5:
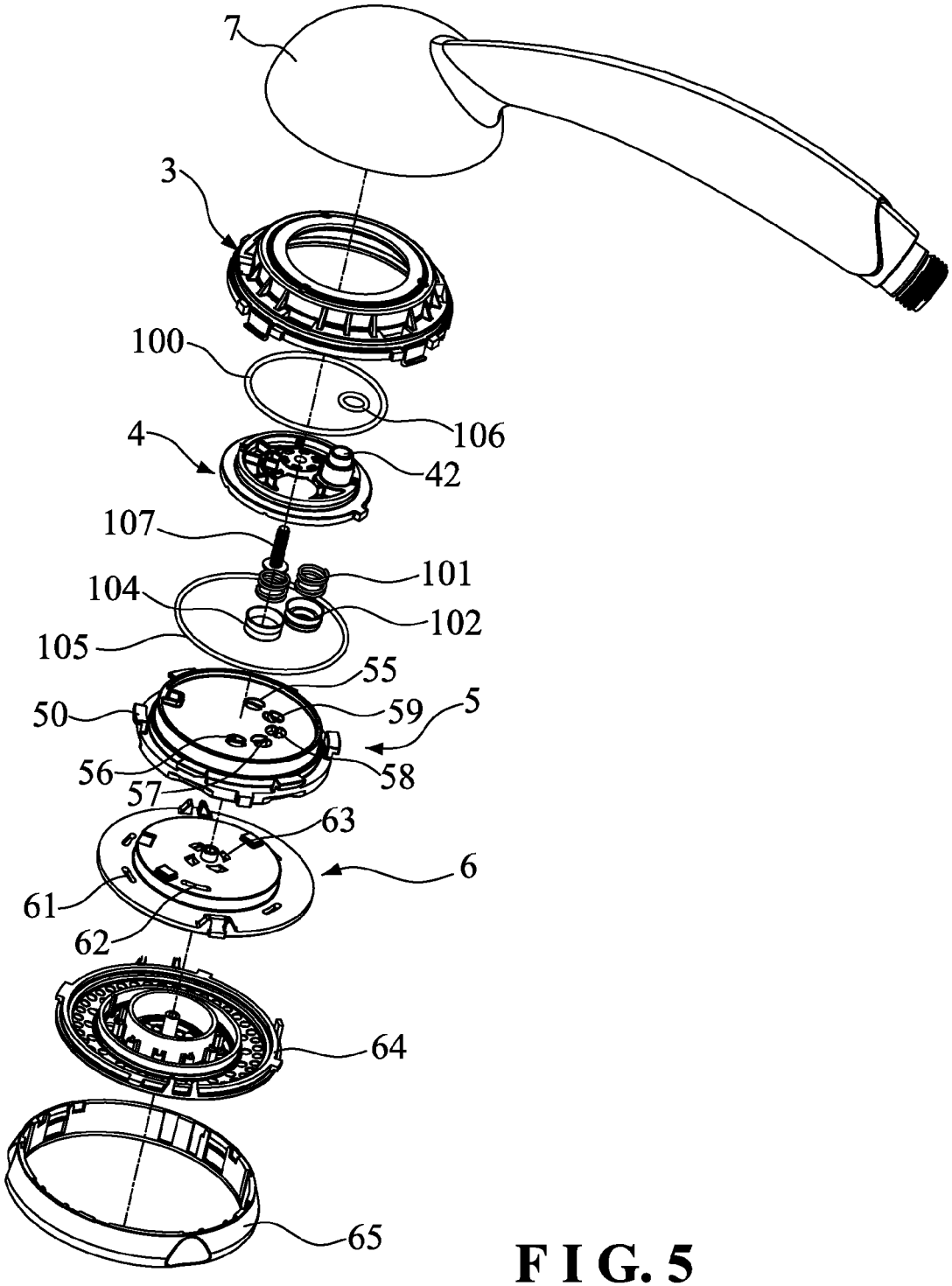
FIG. 5 is an exploded view of the present invention.
Figure 6:
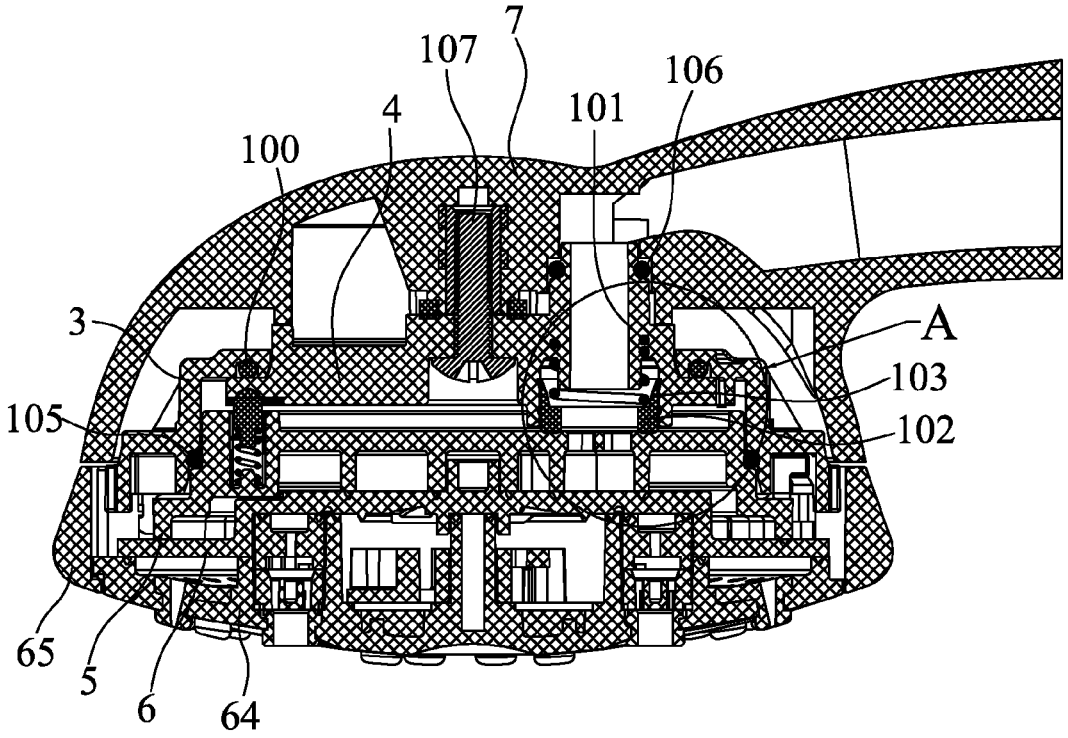
FIG. 6 is a sectional view of the present invention.

As shown in FIG. 5, the shower head according to a preferred embodiment of the present invention comprises a main body 7, a rotation seat 3, a main body seal seat 4, a cover seal seat 5, a cover unit 6, and seal members installed between relative parts for water seal. The main body seal seat 4 is connected to the main body 7. As shown in FIG. 6, in this embodiment, the main body seal seat 4 is connected to the main body 7 through a screw 107. The main body seal seat 4 is fitted in the rotation seat 3 in a rotation way and located above the cover seal seat 5. The cover seal seat 5 is fixed to the cover unit 6.

The joint of the main body seal seat 4 and the rotation seat 3 has a groove to receive a first seal ring 100. The groove can be disposed on the main body seal 4 or the rotation seat 3. In this embodiment, the rotation seat 3 has a first protruding step 33 extending inward. The main body seal seat 4 has a second protruding step 41 extending outward. The first protruding step 33 of the rotation seat 3 is mated with the second protruding step 41 of the main body seal seat 4. The first protruding step 33 and the second protruding step 41 are in a circle shape. Between the first protruding step 33 and the second protruding step 41 is formed with the groove to receive the first seal ring 100. The groove can be disposed on the first protruding step 33 or the second protruding step 41. Preferably, first protruding step 33 of the rotation seat 3 is formed with a groove 331 to receive the first seal ring 100.

Figure 8:
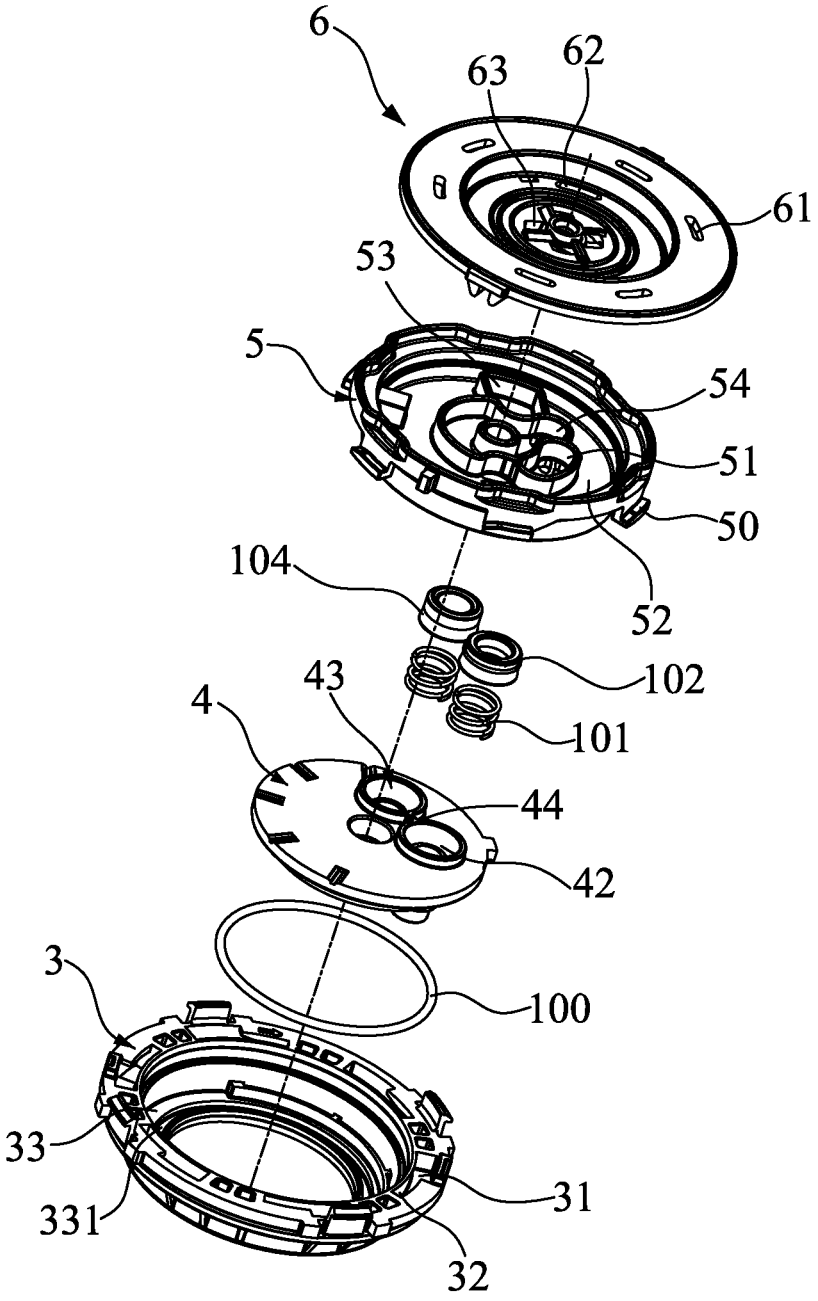
FIG. 8 is another partial exploded view of the present invention.
Figure 9:
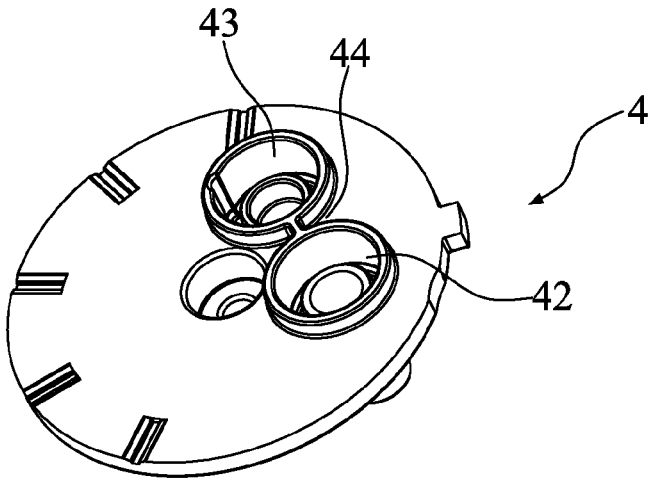
FIG. 9 is a perspective view showing the main body seal seat of the present invention.

As shown in FIG. 8 and FIG. 9, the main body seal seat 4 has at least one water inlet 42. The water inlet 42 is provided with a spring 101 and a second seal ring 102 therein. The spring 101 is located between the second seal ring 102 and the water inlet 42 of the main body seal seat 4. The second seal ring 102 is against the cover seal seat 5. In this embodiment, the second seal ring 102 has a flange 103 extending upward from an outer edge thereof, so that the spring 101 can be secured in the water inlet 42 and the second seal ring 102 can enhance its seal effect.

Figure 7:
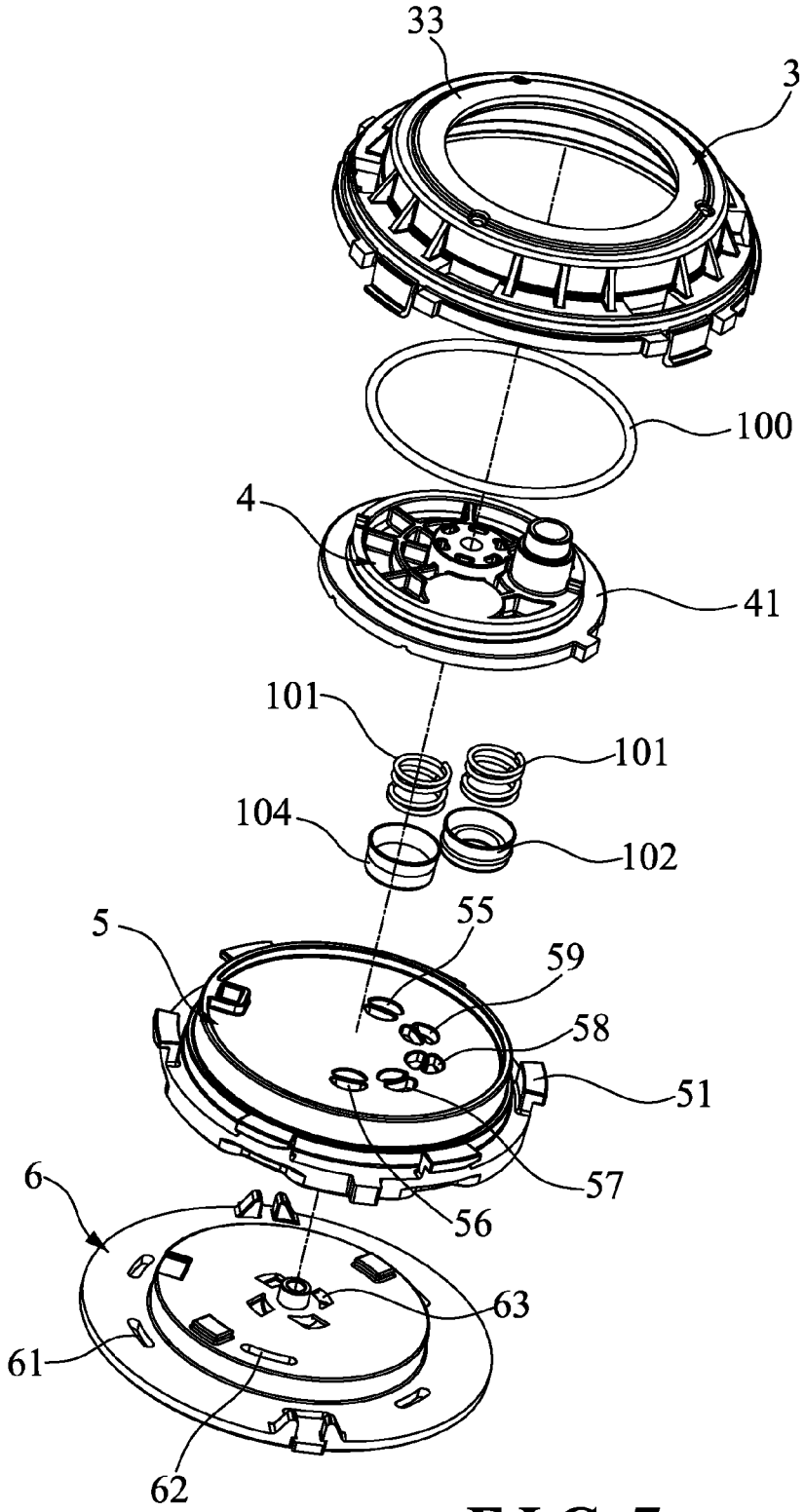
FIG. 7 is a partial exploded view of the present invention.
Figure 10:
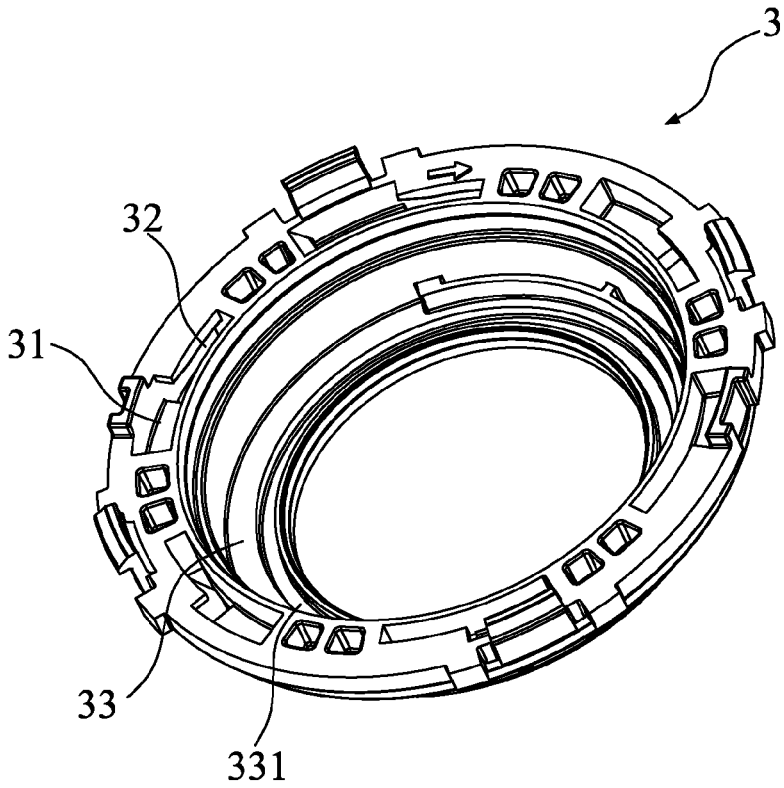
FIG. 10 is a perspective view showing the rotation seat of the present invention.

Referring to FIG. 7, FIG. 8 and FIG. 10, the cover seal seat 5 has at least one through hole, and the cover unit 6 has at least one water outlet. The through hole communicates with the water outlet. In the embodiment, the cover unit 6 has three water outlets, namely, an outer water outlet 61, an inner water outlet 62 and a central water outlet 63. The cover unit 6 further comprises a lid 64 and an electroplated lid 65 for beautiful appearance of the shower head. Three water passages and a shift water passage 51 are formed between the cover seal seat 5 and the cover unit 6. The three water passages are an outer water passage 52 which communicates with the outer water outlet 61, an inner water passage 53 which communicates with the inner water outlet 62, and a central water passage 54 which communicates with the central water outlet 63. The cover seal seat 5 has five through holes which are disposed in the same circle, namely, an outer through hole 55 which communicates with the outer water passage 52, an inner through hole 56 which communicates with the inner water passage 53, a central through hole 57 which communicates with the central water passage 54, a first reverse flow hole 58, and a second reverse flow hole 59. The shift water passage 54 communicates with the first reverse flow hole 58 and the second reverse flow hole 59 for the two reverse flow holes to form a flow passage. The main body seal seat 4 has a blind hole 43 which is located corresponding to the five through holes of the cover seal seat 5. An interval 44 is defined between the water inlet 42 and the blind hole 43. The blind hole 43 comprises a seal pad 104 therein. The water inlet 42 communicates with one of the five through holes of the cover seal seat 5 by means of rotation to open the relative water passage. The blind hole 43 is to block the other through holes and close the other water passages. The circumferential angle between the water inlet 42 and the blind hole 43 is equal to the total circumferential angle of three through holes. The water inlet 42 and the blind hole 43 respectively cover two spaced through holes, and the interval 44 between the water inlet 42 and the blind hole 43 covers the middle through hole.

The cover seal seat 5 has six engaging buckles 50 thereon. The rotation seat 3 has six engaging notches 31 and limit slots 32 extending from the respective engaging notches 31. The engaging buckles 50 of the cover seal seat 5 are inserted in the engaging notches 31 of the rotation seat 3, and then engaged with limit slots 32 of the rotation seat 3 by turning the cover seal seat 5, such that the cover seal seat 5 is coupled to the rotation seat 3. The seal members between relative parts are used to seal water, such as a third seal ring 103 provided between the cover seal seat 5 and the rotation seat 3, and a fourth seal ring 106 provided between the main seal body 4 and the main body 7.

Figure 11:
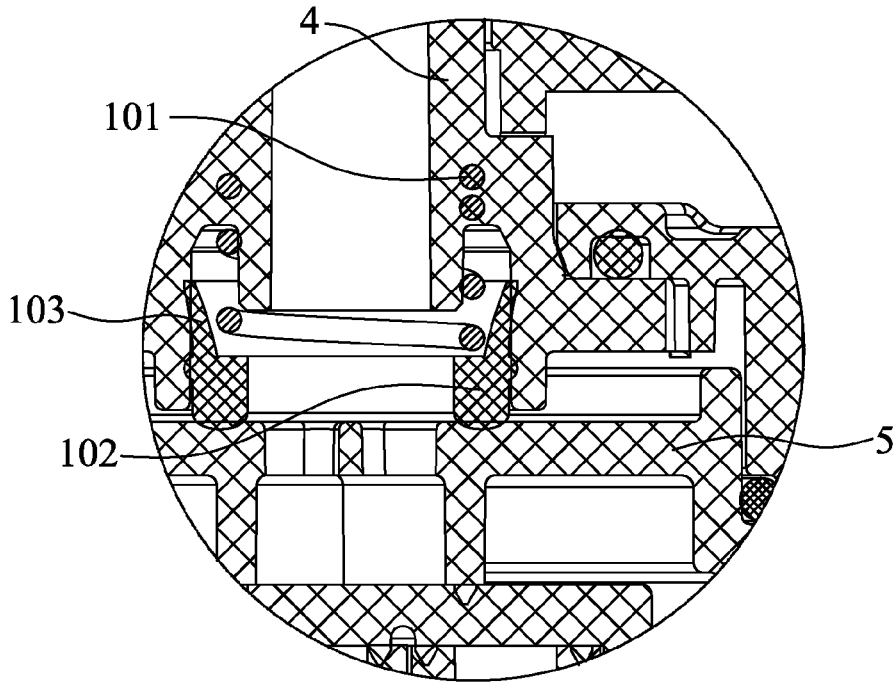
FIG. 11 is an enlarged view of FIG. 6.
Figure 12:
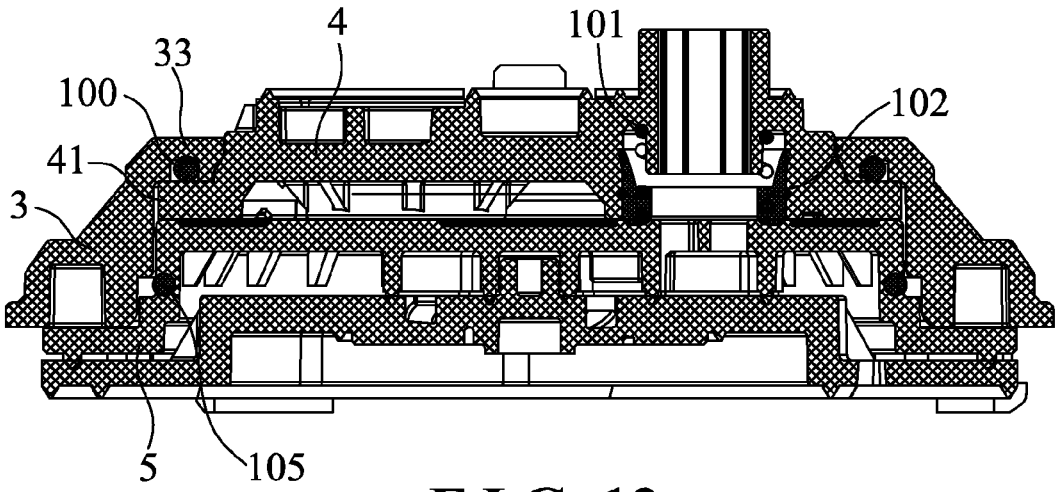
FIG. 12 is a sectional view showing the assembly of the present invention.

Referring the FIG. 6, FIG. 11, FIG. 12, the spring 11 applies a force to the main body seal seat 4 and the second seal ring 102. Because the second seal ring 102 is against the cover seal seat 5, the cover seal seat 5 and the main body seal seat 4 have two opposing forces. One force is to compress the first seal ring 100 between the main body seal seat 4 and the rotation seat 3. The compression is 0.3 mm. The other force pushes the second seal ring 102 to be against the cover seal seat 5 tightly. In this way, the main body seal seat 4 and the cover seal seat 5 have a better and stable seal effect.

To assemble the present invention, the first seal ring 100 is placed in the groove 331 of the rotation seat 3. The main body seal seat 4 is fitted in the rotation seat 3 to form a seal configuration. After that, the spring 101 and the second seal ring 102 are placed in the water inlet 42 of the main body seal seat 4. Two ends of the spring 101 are against the second seal ring 102 and the water inlet 42, respectively. Finally, the engaging buckles 50 of the cover seal seat 5 are inserted in the engaging notches 31 of the rotation seat 3 and then engaged in the limit slots 32 by clockwise turning the cover seal seat 5, so that the cover seal seat 5 is secured under the main body seal seat 4. The present invention can be assembled with ease to lower the defective rate of production.

When the water inlet 42 communicates with the inner through hole 56, the water will pass the water inlet 42, the inner through hole 56, the inner water passage 53 and the inner water outlet 62 in sequence to provide an inner spray mode of the shower head.

When the water inlet 42 communicates with the central through hole 57, the water will pass the water inlet 42, the central through hole 57, the central water passage 54 and the central water outlet 63 in sequence to provide a central spray mode of the shower head.

When the water inlet 42 communicates with the first reverse flow hole 58, the blind hole 43 blocks the inner through hole 56, the interval 44 covers the central through hole 57, the water passes the water inlet 42, the first reverse flow hole 58, the shift water passage 51 and the second reverse flow hole 59 to form two water flows. One water flow passes the interval 44, the central through hole 57, the central passage 34 and the central water outlet 63, and the other water flow passes the outer through hole 55, the outer water passage 52 and the outer water outlet 61. The shower head provides a mixed spray of the central spray mode and the outer spray mod.

When the water inlet 42 communicates with the second reverse flow hole 59, the blind hole 43 blocks the central through hole 57, the interval 44 covers the first reverse flow hole 58, the water passes the water inlet 42, the second reverse flow hole 59, the shift water passage 51, the first reverse flow hole 58 and the interval 44 to form two water flows. One water flow passes the inner through hole 56, the inner water passage 53 and the inner water outlet 62, and the other water flow passes the outer through hole 55, the outer water passage 52 and the outer water outlet 61. The shower head provides a mixed spray of the inner spray mode and the outer spray mod.

When the water inlet 42 communicates with the outer through hole 55, the water will pass the water inlet 42, the outer through hole 55, the outer water passage 52 and the outer water outlet 61 in sequence to provide an outer spray mode.

Through the shift water passage 51 formed between the cover seal seat 5 and the cover unit 6 of the present invention, the water enters the cover seal seat 5 once again and flows to the unsealed through holes to achieve the mixed spray function. The present invention is simple in configuration and can be manufactured easily and may be applied to various structures for water outflow.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A shower head, comprising a main body, a rotation seat, a main body seal seat, a cover seal seat, a cover unit and seal members installed between relative parts for water seal, the main body seal seat being connected to the main body, the main body seal seat being fitted in the rotation seat in a rotation way and located above the cover seal seat, the cover seal seat being fixed to the cover unit; the main body seal seat and the rotation seat having a joint formed with a groove to receive a first seal ring; the main body seal seat having at least one water inlet, the water inlet being provided with a spring and a second seal ring therein, the spring being located between the second seal ring and the water inlet of the main body seal seat, the second seal ring being against the cover seal seat; the cover seal seat having at least one through hole, the cover unit having at least one water outlet, the at least one through hole communicating with the at least water outlet, wherein the rotation seat has a first protruding step extending inward and the main body seal seat has a second protruding step extending outward, the first protruding step of the rotation seat being mated with the second protruding step of the main body seal seat, the first protruding step being formed with the groove to receive the first seal ring.

2. The shower head as claimed in claim 1, wherein the second seal ring has a flange extending upward from an outer edge thereof.

3. The shower head as claimed in claim 1, wherein the cover unit has three water outlets which are an outer water outlet, an inner water outlet and a central water outlet, three water passages and a shift water passage formed between the cover seal seat and the cover unit, the cover seal seat having five through holes which are disposed in a circle, the main body seal seat having a blind hole which is located corresponding to the five through holes of the cover seal seat, an interval defined between the water inlet and the blind hole, the blind hole comprising a seal pad therein, the water inlet communicating with one of the five through holes of the cover seal seat by means of rotation to open the relative water passage, the blind hole being to block the other through holes and close the other water passages.

4. The shower head as claimed in claim 1, wherein the cover seal seat has engaging buckles thereon, and the rotation seat has engaging notches and limit slots extending from the respective engaging notches.

* * * * *